US006164199A

United States Patent [19]

Dubuit et al.

[11] Patent Number: 6,164,199

[45] Date of Patent: Dec. 26, 2000

[54] PRINTING MACHINE WITH ROTATABLY MOUNTED OBJECT-CARRIER SUPPORTS

[75] Inventors: Jean-Louis Dubuit, Paris; Frédéric Airoldi, Servon, both of France

[73] Assignee: Societe D'Exploitation des Machines Dubuit, Noisy Le Grand, France

[21] Appl. No.: 09/371,780

[22] Filed: Aug. 10, 1999

[30] Foreign Application Priority Data

Aug. 13, 1998 [FR] France ..... 98 10377

[51] Int. Cl.[7] ..... B41F 17/08

[52] U.S. Cl. ..... 101/38.1; 101/124

[58] Field of Search ..... 101/38.1, 39, 40, 101/40.1, 114, 115, 123, 126, 124

[56] References Cited

U.S. PATENT DOCUMENTS

| | | | |
|---|---|---|---|
| 2,221,323 | 11/1940 | Gammeter | 101/38.1 |
| 2,461,281 | 2/1949 | Jackson et al. | 101/123 |
| 2,484,671 | 10/1949 | Bauman . | |
| 3,209,688 | 10/1965 | Eldred et al. | 101/38.1 |
| 3,253,538 | 5/1966 | Rudolph et al. . | |
| 4,750,419 | 6/1988 | Meredith | 101/40 |

FOREIGN PATENT DOCUMENTS

| | | |
|---|---|---|
| 2138146 | 12/1972 | France . |

*Primary Examiner*—Ren Yan
*Attorney, Agent, or Firm*—Young & Thompson

[57] ABSTRACT

In a printing machine with object-carrier supports mounted to rotate, rotation drive units are used at printing stations and at processing stations to drive rotation of the object-carrier supports. The drive systems of the rotation drive units corresponding to the printing stations are separate from the drive systems of the rotation drive units corresponding to the processing stations. Applications include multicolor printing of flexible tubes.

7 Claims, 3 Drawing Sheets

PRINTING MACHINE WITH ROTATABLY MOUNTED OBJECT-CARRIER SUPPORTS

BACKGROUND OF THE INVENTION

1. Field of the Invention

The present invention is generally concerned with printing machines including a turret, which is mounted to rotate about its axis and which carries, radially, at its periphery, a plurality of object-carrier supports which are themselves mounted to rotate on the turret, and a plurality of workstations which are circumferentially distributed around the turret, in line with the path of the object-carrier supports, and some of which are printing stations while others are processing stations such as, for example, drying, varnishing, flame treatment, dust removal or other stations.

2. Description of the Prior Art

Such printing machines are used to print circular objects, for example, such as flexible tubes, for example, made of synthetic and other materials and adapted to be printed with several different colors in succession.

Whether the printing stations are screenprinting or offset printing stations, for example, or gold blocking printing stations, it is important for the object-carrier supports to maintain the same orientation from one to the other so that at each of them the printing is properly indexed relative to a common reference.

To this end, the object-carrier supports are usually each constrained to rotate with a gear that meshes with a central ring common to all of them.

This arrangement, which has the advantage of simplicity, because it provides the required synchronization mechanically, has the drawback of entailing identical rotation of the object-carrier supports at all the workstations, i.e. not only at the printing stations but also at any processing stations between the printing stations.

When the turret advances by one step from one workstation to the other, the object-carrier supports are inevitably subject to differential rotation movement because their gears mesh with the central ring.

Although it is possible to take account of this differential rotation movement in indexing the printing, at processing stations, such as ultraviolet radiation drying stations, for example, which require the objects to rotate through more than one revolution, there can be a risk of untimely overexposure of the objects to a greater or lesser degree on one side and underexposure to a greater or lesser degree on the diametrally opposite side.

A different approach has therefore been proposed, in order to retain the orientation of the object-carrier supports from one workstation to another, in particular in U.S. Pat. No. 3,253,538.

To be more precise, it has been proposed to associate a rotation drive finger with each object-carrier support, at an eccentric position relative to its axis, and to equip the printing machine with a fixed plate parallel to the turret and having at its periphery a groove in which the rotation drive fingers of the object-carrier supports are engaged. Rotation drive units which interrupt the groove locally, from place to place, are mounted to rotate under the control of drive means. Some of the drive units are each individually associated with printing stations and others are each individually associated with processing stations. Each drive unit includes a groove in which the rotation drive fingers of the object-carrier supports are successively engaged turn and turn about.

Accordingly, there is no differential rotation movement of the object-carrier supports between the workstations.

However, at present, the drive means are common to all the rotation drive units so that, as previously, the rotation of the object-carrier supports is the same at all the workstations, whether they are printing stations or processing stations.

It is desirable for different rotations to be possible at some workstations at least.

A general object of the present invention is an arrangement that satisfies this requirement.

SUMMARY OF THE INVENTION

To be more precise, the present invention consists in a printing machine including a turret mounted to rotate about its axis and carrying, radially, at its periphery, a plurality of object-carrier supports mounted to rotate on the turret and a rotation drive finger associated with each of the object-carrier supports and at an eccentric position relative to its axis, a plurality of workstations circumferentially distributed around the turret in line with the path of the object-carrier supports, some of which are printing stations and others of which are processing stations, a fixed plate parallel to the turret and having a groove at its periphery with which the rotation drive fingers of the object-carrier supports are engaged, and rotation drive units locally interrupting the groove from place to place and mounted to rotate under the control of drive means, which drive units each comprise a groove in which the rotation drive fingers of the object-carrier supports are engaged successively turn and turn about, wherein some of the drive units are each individually associated with the printing stations, others of the drive units are each individually associated with the processing stations and the drive means of the rotation drive units associated with the printing stations are separate from the drive means of the rotation drive units associated with the processing stations.

It is therefore advantageously possible to have different rotation values at the printing stations, on the one hand, and at the processing stations, on the other hand.

For example, in one preferred embodiment of the invention, the drive means of the rotation drive units associated with the printing stations include a motor and an endless belt passing around a plurality of pulleys, one of which is constrained to rotate with an output shaft of the motor, and likewise for the drive means of the rotation drive units associated with the processing stations, the two belts being operative at different levels.

In the case of the rotation drive units associated with the printing stations, the use of a digitally controlled motor of the above kind has the advantage that the angular position of the object-carrier supports is known at all times so that the printing stations can be controlled accordingly.

If the printing stations are screenprinting stations, for example, it is therefore possible to modulate at will the displacement of the corresponding screen to lengthen or shorten the decoration applied to an object, for example in accordance with a variation in its diameter as a function of its temperature.

All that is required is to control the displacement of the screen at each printing station accordingly, by means of an individual motor provided specifically for this purpose.

To facilitate this operation, the motor is preferably a digitally controlled motor operating in tracking mode relative to the main motor driving all the corresponding rotation drive units conjointly.

Accordingly, at the printing stations, there is an individual motor for each printing station in addition to the main motor common to all of them.

At the processing stations, on the other hand, there is only one motor, namely a main motor driving the corresponding rotation drive units conjointly.

Finally, in accordance with the invention, individual clutch means are preferably provided for at least one of the object-carrier supports, between the object-carrier support and the associated rotation drive finger; this enables the object-carrier support to rotate freely about its axis, if required, independently of the other object-carrier supports.

It is therefore advantageously possible to increase the rotation of the object-carrier supports at some workstations, for example at a varnishing station, if the objects must be lacquered to prevent them oxidizing before carrying out the first printing operation.

The individual clutch means advantageously also enable initial indexing of the objects, i.e. control of their orientation relative to any given reference.

The features and advantages of the invention will emerge from the following description given by way of example and with reference to the accompanying diagrammatic drawings.

DETAILED DESCRIPTION OF THE PREFERRED EMBODIMENT

Figure 4:
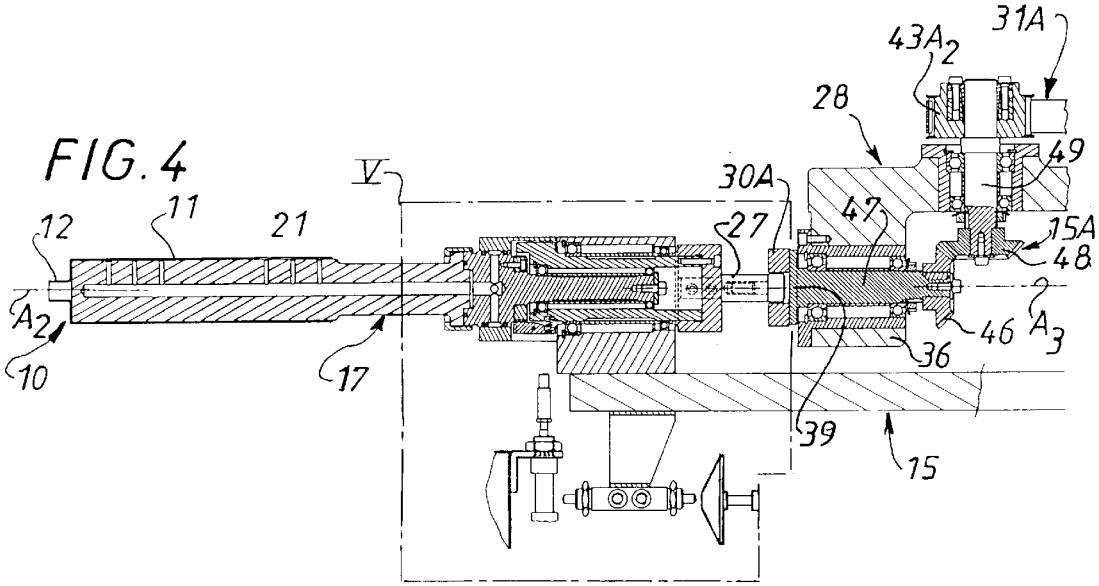
FIG. 4 shows the detail IV from FIG. 3 to a larger scale.

The figures show, by way of example, the application of the invention to the situation in which, as seen in FIG. 4 in the case of one of them, the objects 10 to be printed are flexible tubes which are intended to contain a more or less pasty product, for example cream, and which have a body 11 and a neck 12.

Initially open at the end opposite the neck 12, the body 11 is globally cylindrical and its cross section is substantially circular.

The printing machine 14 used to print such objects 10 includes, in a conventional manner, a turret 15 which is mounted to rotate about its axis A1, which here is a vertical axis, on a frame 16 and which carries, radially, at its periphery, a plurality of object-carrier supports 17 each mounted to rotate on the turret 15 about a respective axis A2 which in this example is orthogonal to the axis A1 of the turret 15 and therefore horizontal.

Figure 3:
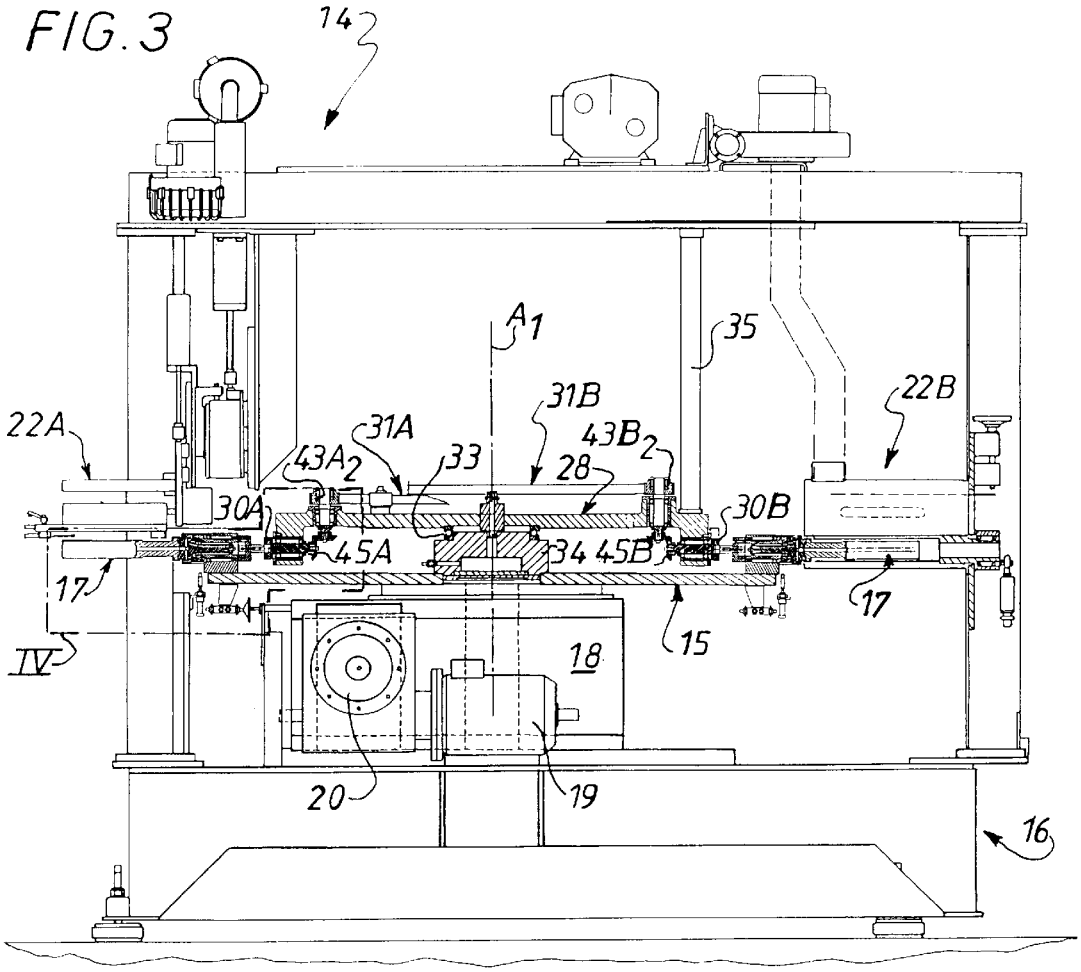
FIG. 3 is a view of the printing machine in accordance with the invention in axial section taken along the line III—III in FIG. 1.

In the embodiment shown, the turret 15 is a simple plate with a circular contour and is mounted to rotate on a table 18 which is part of the frame 16 (FIG. 3).

In a conventional manner, the turret 15 is driven in stepwise rotation by a motor 19 associated with an indexing unit 20.

Because the objects 10 to be printed are flexible tubes, the object-carrier supports 17 are cylindrical mandrels onto which the objects 10 are simply threaded.

In the embodiment shown, and as seen better in FIG. 4, the object-carrier supports 17 are hollow and, to stabilize the objects 10 to be printed, they have on their surface an array of nozzles 21 connected to any kind of suction means.

The corresponding arrangements are conventional and will not be described in more detail here.

Also in a conventional manner, the printing machine 14 includes a plurality of workstations 22, here workstations 22A, 22B (FIG. 1), which are circumferentially distributed around the turret 15, in line with the path of the object-carrier supports 17, some of which (22A) are printing stations and others of which (22B) are processing stations.

In the embodiment shown, there are four printing stations 22A for four-color screenprinting the objects 10 to be printed.

A printing station using the offset process and/or a gold blocking printing station can be added to or substituted for at least one of them, however.

The printing stations 22A will not be described here because they are conventional and are not of themselves relevant to the present invention.

It is nevertheless necessary to indicate that at each printing station 22A there is preferably an individual motor (not shown) for moving the corresponding screen and that this motor is a digitally controlled motor.

In the embodiment shown, the processing stations 22B are drying stations.

These drying stations use ultraviolet radiation, for example.

The drying stations will not be described here either because they are conventional and are not of themselves relevant to the present invention.

In practise, each printing station 22A is followed by a processing station 22B.

The system is completed by a loading and offloading station 23 and, for pretreatment of the objects 10 before they are printed, workstations 22 appropriate to that effect, for example a flame treatment and dust removal station 22C and a varnishing station 22D followed by a drying station, i.e. a treatment station 22B.

In the embodiment shown, there are therefore five processing stations 22B, namely four for the printing stations 22A and one for the varnishing station 22D.

Finally, for the necessary indexing, in a conventional manner and as described in more detail below, each of the object-carrier supports 17 has a rotation drive finger 27 at an eccentric position relative to its axis A2; conjointly, the printing machine 14 includes a fixed plate 28 parallel to the turret 15 and having a groove 29 at its periphery with which the rotation drive fingers 27 of the object-carrier support 17 are engaged; rotation drive units 30A, 30B locally interrupt the groove 29 from place to place, and are mounted to rotate under the control of drive means 31A, 31B, some of them being each individually associated with printing stations 22A and others with processing stations 22B, which themselves each comprise a groove 32 in which the rotation drive fingers 27 of the object-carrier support 17 engage successively turn and turn about.

In the embodiment shown, the fixed plate 28 lies above the turret 15 and, resting on a unit 34 disposed axially at the center of the turret 15 on bearing means 33, it is coupled to the frame 16 by suspension members 35 (FIG. 3).

Like the turret 15, the fixed plate 28 has a circular contour periphery.

Figure 7:
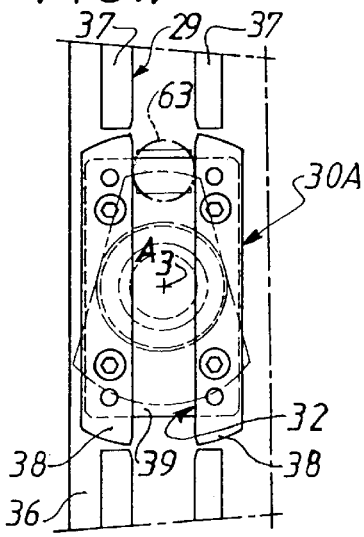
FIG. 7 is a partial side view of it as seen in the direction of the arrow VII in FIG. 6.

In the embodiment shown, it has an upstanding edge 36 at is periphery and the groove 29 is on the outside surface of the upstanding edge 36 (FIG. 7).

In practise, the groove 29 is formed between two parallel ribs 37 which are attached to the upstanding edge 36 for this purpose.

Likewise, the groove 32 of each of the rotation drive units 30A, 30B is formed between two parallel ribs 38 on a common support flange 39 which is part of a rotation drive unit 30A, 30B of the above kind.

In practise, the rotation drive units 30A, 30B all have the same structure and their groove 32 is the same width as the groove 29 of the fixed plate 28.

The rotation drive units 30A, 30B on the fixed plate 28 have axes A3.

According to the invention, the drive means 31A of the rotation drive units 30A associated with the printing stations 22A are separate from the drive means 31B of the rotation drive units 30B associated with the processing stations 22B.

Figure 1:
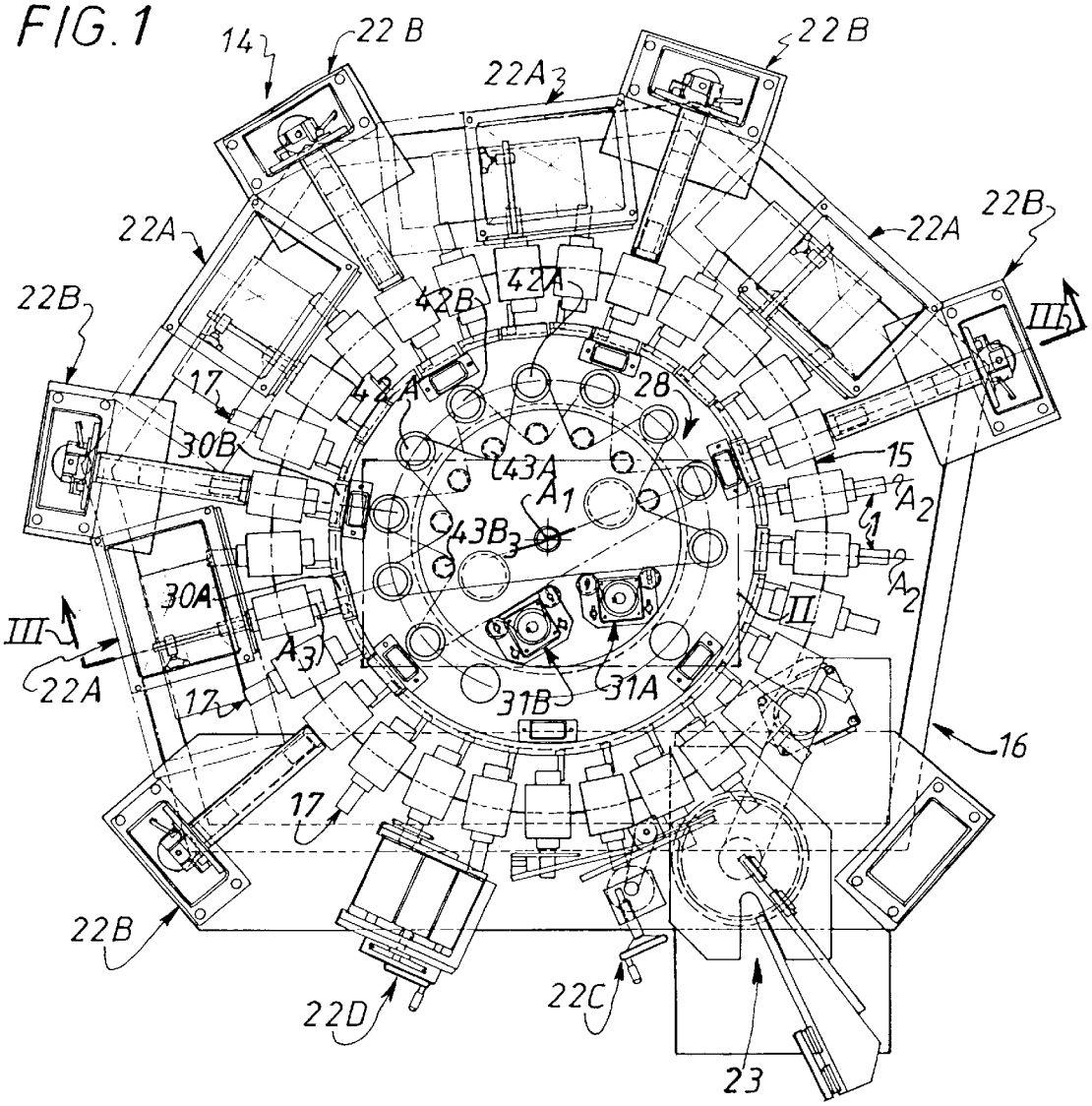
FIG. 1 is a plan view of a printing machine in accordance with the invention.
Figure 2:
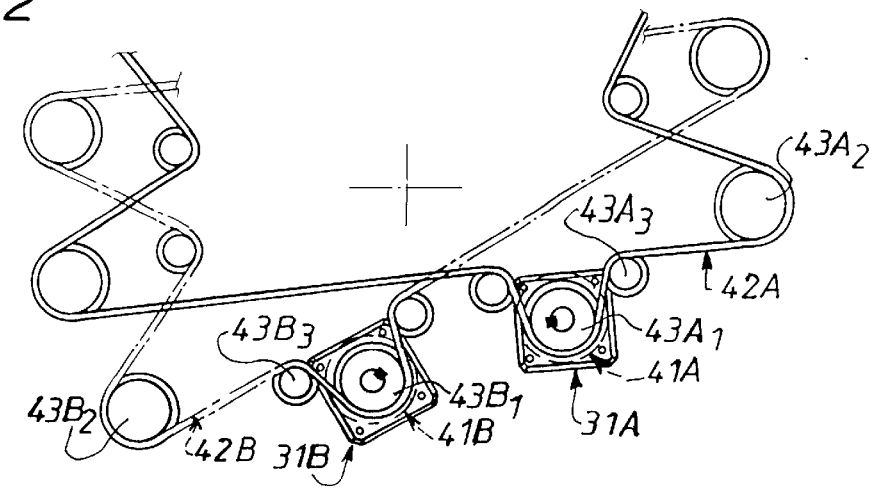
FIG. 2 shows the detail II from FIG. 1 diagrammatically and to a larger scale.

In the embodiment shown, the drive means 31A of the rotation drive units 30A associated with the printing stations 22A include a motor 41A and an endless belt 42A running around pulleys 43A1, 43A2, 43A3, one of which (43A1) is constrained to rotate with the output shaft of the motor 41A, while others (43A2) are each individually constrained to rotate with the rotation drive units 30A and the latter, i.e. the pulleys 43A3, are simple direction-changer pulleys (FIGS. 1 and 2).

The same applies to the drive means 31B for the rotation drive units 30B associated with the processing stations 22B.

In other words, the drive means 31B include a motor 41B, a belt 42B and pulleys 43B1, 43B2 and 43B3.

In practise, the two belts 42A, 42B used in this way are different levels to prevent them interfering with each other.

In the embodiment shown, they are parallel to and above the fixed plate 28, the various pulleys 43A1, 43A2, 43A3, 43B1, 43B2, 43B3 over which they pass all having parallel axes perpendicular to the fixed plate 28 and parallel the axis A1 of the turret 15.

Between each rotation drive unit 30A, 30B and the corresponding pulley 43A2, 43B2 there is therefore a direction changer 45A, 45B protected by the fixed plate 28 and the upstanding edge 36 thereof (FIGS. 3 and 4).

For example, and as can be seen for one direction changer 45A in FIG. 4, each of the direction changers 45A, 45B used in this way includes a bevel gear 46 which is constrained to rotate with the support flange 49 of the corresponding rotation drive unit 30A, 30B, and a bevel gear 48 which meshes with the aforementioned bevel gear 46 and which, by means of a pin 49 that passes through the fixed plate 28, is constrained to rotate with the associated pulley 43A2, 43B2.

The motors 41A, 41B in the drive means 31A, 31B of the rotation drive units 30A, 30B are preferably digitally controlled motors.

The motors 41A, 41B are not described here because they are conventional and are not of themselves relevant to the present invention.

Also, they are merely symbolized in chain-dotted outline in FIG. 2 and are not represented at all in the other figures.

The digitally controlled motors drive the displacement of the screens at the printing station 22A, each operating in tracking mode relative to the motor 41A in the drive means 31A of the corresponding rotation drive units 30A.

Preferably, as in the embodiment shown, individual clutch means 50 are provided between at least one of the object-carrier supports 17, for example each object-carrier support 17, and the associated rotation drive finger.

Figure 5:
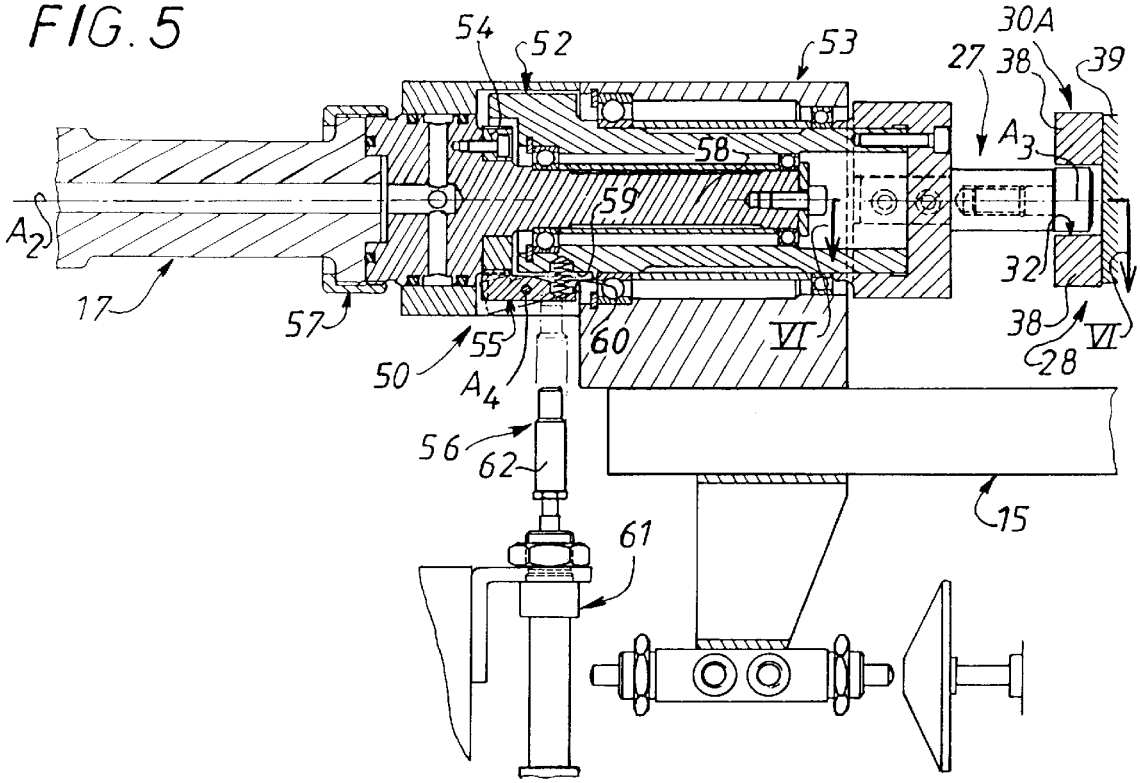
FIG. 5 shows the detail V from FIG. 4 to a still larger scale.

In the embodiment shown, and as seen better in FIG. 5, each of the object-carrier supports 17 is mounted to rotate relative to a bush 52 which is in turn mounted to rotate relative to a support unit 53 fastened to the turret 15 and to which the associated rotation drive finger 27 is keyed, and the corresponding individual clutch means 50 include a gear 54 which is constrained to rotate with the object-carrier support 17 and a pawl 55 which is carried by the bush 52 and which is mounted to pivot under the control of the drive means 56 between a drive position in which, as shown in continuous line in FIG. 5, it is engaged with the gear 54 and a released position in which, as shown diagrammatically in chain-dotted line in FIG. 5, it is to the contrary at a distance from the gear 54.

In the embodiment shown, the object-carrier support 17 is cantilevered from the bush 52 which carries it, being attached by a ring 57 to the end of a shaft 58 mounted to rotate therein.

The corresponding support unit 53 is parallel to the top surface of the turret 15.

In the embodiment shown, the pawl 55 of the individual clutch means 50 of the object-carrier support 17 is in practise mounted to pivot about an axis A4 orthogonal to the axis A2 of the object-carrier support 17 and, for guidance, and also to take up the corresponding rotation load, it operates within an elongate notch 59 in the bush 52 parallel to its generatrices, i.e. parallel to the axis A2 of the object-carrier support 17.

In the embodiment shown, the drive means 56 of the pawl 55 include, on the turret 15, between the bush 52 and the pawl 55, a return spring 60 which spring-loads the pawl toward the drive position and, at each workstation 22 concerned, an actuator 61 whose piston 62 is adapted to move the pawl to a released position, as symbolized in chain-dotted outline in FIG. 5.

As in the embodiment shown, the rotation drive finger 27 of each object-carrier support 17 preferably has at its end a roller 63 which is mounted to rotate and by which it is adapted to interengage with the groove 29 on the fixed plate 28 and with the groove 32 on the rotation drive units 30A, 30B, as symbolized in chain-dotted line in FIG. 7.

When, guided by the groove 29 on the fixed plate 28, the rotation guide finger 27 of an object-carrier support 17 reaches a rotation drive unit 30A, 30B, the groove 32 on the latter is systematically aligned with the groove 29 on the fixed plate 28, as shown in FIG. 7, so that the rotation drive finger 27 can engage without damage in the groove 32 on the rotation drive unit 30A, 39B.

The turret 15 is then stopped.

By design, when the turret 15 is stopped in this way, the axis A2 of the object-carrier support 17 is substantially in line with the axis A3 of the rotation drive unit 30A, 30B in front of which it is located.

Figure 6:
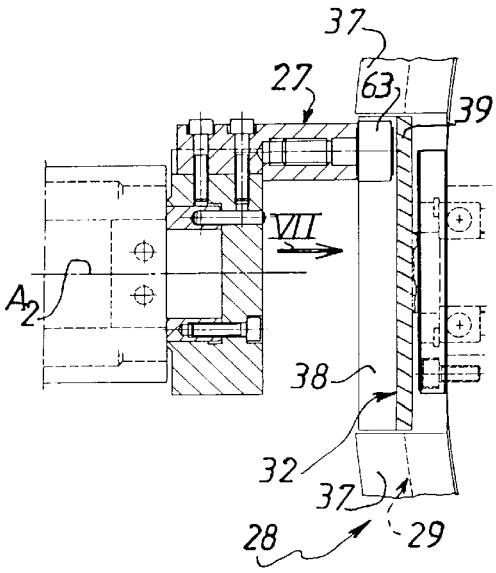
FIG. 6 is a partial view of the printing machine in accordance with the invention in section taken along the line VI—VI in FIG. 5.

Its rotation drive finger 27, to be more precise the roller 63 the latter carries, is consequently at a distance from the axis A3, as represented or symbolized in FIGS. 6 and 7.

As a result, when the rotation drive unit 30A, 30B concerned is driven in rotation by the corresponding drive means 31A, 31B, it drives the object-carrier support 17 in rotation about its axis A2.

If the object-carrier supports 17 are required to be able to turn freely, for example at the varnishing station 22D, all that is required is to operate the actuator 61 of the control means 56 of the individual clutch means 50 included in the station accordingly.

Coming to bear on the pawl 55 of the individual clutch means 50, the piston 62 of the actuator 61 releases the object-carrier support 17 relative to the bush 52 carrying it and thereby releases it from the corresponding rotation drive unit 30A, 30B.

When the actuator 61 is released, the return spring 60 returns the pawl 55 to its initial driving position.

Of course, the present invention is not limited to the embodiment described and shown, but encompasses any variant execution thereof.

There is claimed:

1. A printing machine including a turret mounted to rotate about a turret axis;

a plurality of object-carrier supports each rotatable mounted at a periphery of said turret to rotate about a respective object-carrier support axis;

a rotation drive finger associated with each of said object-carrier supports, each rotation drive finger being mounted at an eccentric position relative to the respective object-carrier support axis;

a plurality of workstations circumferentially distributed around said turret in line with a path of said object-carrier supports, some of the workstations being printing stations and others of the workstations being processing stations;

a fixed plate parallel to said turret and having a groove at a periphery thereof, said groove being adapted to engage said rotation drive fingers of said object-carrier supports, said fixed plate further comprising rotation drive units locally interrupting said groove from place to place and mounted to rotate under control of drive means, each said drive unit comprising a groove in which said rotation drive fingers of said object-carrier supports are engaged successively turn and turn about;

wherein some of said drive units are each individually associated with said printing stations, others of said drive units are each individually associated with said processing stations and said drive means of said rotation drive units associated with said printing stations are separate from said drive means of said rotation drive units associated with said processing stations.

2. The printing machine claimed in claim 1 wherein said drive means of said rotation drive units associated with said printing stations includes a first motor and a first endless belt passing around a plurality of first pulleys, one of the first pulleys being constrained to rotate with an output shaft of said first motor, and wherein said drive means of said rotation drive units associated with said processing stations includes a second motor and a second endless belt passing around a plurality of second pulleys, one of the second pulleys being constrained to rotate with an output shaft of said second motor, said first and second belts being operative at different levels.

3. The printing machine claimed in claim 2, wherein said first motors in said drive means of said rotation drive units associated with said printing stations and said second motors associated with said processing stations are digitally controlled motors.

4. The printing machine claimed in claim 3 wherein said printing stations are screenprinting stations, an individual screen motor being provided at each said printing station to drive a corresponding screen, said screen motor being a digitally controlled motor operating in tracking mode relative to said first motor in said drive means of the corresponding rotation drive units.

5. A printing machine as claimed in claim 1 including individual clutch means between at least one said object carrier support and the associated rotation drive finger.

6. The printing machine claimed in claim 5 wherein each said object-carrier support is mounted to rotate relative to a bush, said bush being mounted to rotate relative to a support unit fastened to said turret to which the associated rotation drive finger is keyed, said associated individual clutch means including a gear which is constrained to rotate with said object-carrier support and a pawl which is carried by said bush and which is mounted to pivot under control of the drive means between a drive position in which the pawl is engaged with said gear and a released position in which the pawl is at a distance from said gear.

7. The printing machine claimed in claim 6 wherein said drive means of said pawl include a return spring by which the drive means is spring-loaded into said drive position and an actuator whose piston is adapted to move the drive means to said released position.

* * * * *